US007667166B2

(12) United States Patent
Zeyen et al.

(10) Patent No.: US 7,667,166 B2
(45) Date of Patent: Feb. 23, 2010

(54) HEAT-GENERATING ELEMENT OF A HEATING DEVICE

(75) Inventors: Michael Zeyen, Herxheim-Hayna (DE); Kurt Walz, Hagenbach (DE); Michael Niederer, Kappellen-Drusweiler (DE); Franz Bohlender, Kandel (DE)

(73) Assignee: Catem GmbH & Co. KG (DE)

( * ) Notice: Subject to any disclaimer, the term of this patent is extended or adjusted under 35 U.S.C. 154(b) by 426 days.

(21) Appl. No.: 11/534,387

(22) Filed: Sep. 22, 2006

(65) Prior Publication Data

US 2007/0068913 A1 Mar. 29, 2007

(30) Foreign Application Priority Data

Sep. 23, 2005 (EP) ..... 05020752

(51) Int. Cl.
*H05B 3/10* (2006.01)

(52) U.S. Cl. ..... 219/552; 219/553; 165/175; 392/502

(58) Field of Classification Search ..... 219/202, 219/504, 505, 520, 536, 537, 540, 541, 544, 219/548, 533; 392/347, 380; 156/291, 292
See application file for complete search history.

(56) References Cited

U.S. PATENT DOCUMENTS 4,939,349 A * 7/1990 Liu ..... 219/552
4,948,953 A * 8/1990 Starck ..... 219/504
4,990,748 A * 2/1991 Starck ..... 392/485
5,028,763 A * 7/1991 Chung-Tai ..... 219/530
5,057,672 A * 10/1991 Bohlender et al. ..... 219/540
5,239,163 A * 8/1993 Brouwers ..... 219/202
5,326,418 A * 7/1994 Yeh ..... 156/291
5,377,298 A * 12/1994 Yang ..... 392/360
5,471,034 A * 11/1995 Kawate et al. ..... 219/485
5,562,844 A * 10/1996 Bohlender et al. ..... 219/540
5,598,502 A * 1/1997 Takahashi et al. ..... 392/502
5,665,261 A 9/1997 Damsohn
5,854,471 A * 12/1998 Tadokoro et al. ..... 219/540

(Continued)

FOREIGN PATENT DOCUMENTS

DE 2804749 A1 8/1979

(Continued)

*Primary Examiner*—Thor S Campbell
(74) *Attorney, Agent, or Firm*—Boyle Fredrickson, S.C.

(57) ABSTRACT

A heat-generating element of a heating device for heating air includes at least one PTC element and, lying on opposing side surfaces of the PTC element, electric strip conductors. A heat-generating element that is improved with a view to safety from electric flashovers and leakage currents is created with the invention under consideration by providing an insulating gap between the PTC element and the positioning frame material that circumferentially surrounds the frame opening. Also disclosed is a heating device for heating air with multiple heat-generating elements, each heat-generating element comprising at least one PTC element and, lying on opposing side surfaces of the PTC element, electric strip conductors and multiple heat-emitting elements that are arranged in parallel layers and that are held in position in a frame on opposing sides of the heat-generating element with a spring bias. Due to the use of a heat-generating element, the heating device is protected from electric flashovers and leakage currents with a higher degree of certainty.

20 Claims, 6 Drawing Sheets

U.S. PATENT DOCUMENTS

| | | | | |
|---|---|---|---|---|
| 6,178,292 | B1 * | 1/2001 | Fukuoka et al. | 392/485 |
| 6,720,536 | B2 * | 4/2004 | Bohlender | 219/504 |
| 6,723,966 | B2 * | 4/2004 | Jiang | 219/505 |
| 6,957,013 | B2 * | 10/2005 | Zimmer | 392/397 |
| 7,012,225 | B2 * | 3/2006 | Bohlender et al. | 219/536 |
| 7,064,301 | B2 * | 6/2006 | Han et al. | 219/540 |
| 7,297,901 | B2 * | 11/2007 | Lee | 219/202 |
| 2003/0206730 | A1 | 11/2003 | Golan | |
| 2005/0056637 | A1 * | 3/2005 | Bohlender et al. | 219/536 |
| 2005/0072774 | A1 * | 4/2005 | Bohlender | 219/548 |
| 2005/0133490 | A1 * | 6/2005 | Brun et al. | 219/202 |
| 2007/0095809 | A1 * | 5/2007 | Lee | 219/222 |
| 2007/0114217 | A1 * | 5/2007 | Bohlender et al. | 219/202 |
| 2007/0187384 | A1 * | 8/2007 | Colette et al. | 219/216 |
| 2008/0061159 | A1 * | 3/2008 | Okano et al. | 237/12.3 A |
| 2008/0073336 | A1 * | 3/2008 | Bohlender et al. | 219/467.1 |

FOREIGN PATENT DOCUMENTS

| | | | |
|---|---|---|---|
| DE | 3208802 | A | 9/1983 |
| DE | 10118599 | A1 | 11/2002 |
| DE | 102 13 923 | A1 | 10/2003 |
| EP | 0 026 457 | B1 | 4/1981 |
| EP | 1061776 | A1 | 12/2000 |
| EP | 1467599 | A2 | 10/2004 |

* cited by examiner

HEAT-GENERATING ELEMENT OF A HEATING DEVICE

BACKGROUND OF THE INVENTION

1. Field of the Invention

The invention under consideration relates to a heat-generating element of a heating device for heating air, comprising at least one PTC element and, lying on opposing side surfaces of the PTC element, electric strip conductors. Such a heat-generating element is known, for example, from EP 1 061 776, which is traced back to the current applicant.

In particular, the heat-generating element is deployed in an auxiliary heater for a motor vehicle, and comprises multiple PTC elements, arranged in a row, one behind the other, that are energized via electric strip conductors that extend parallel to one another and that lie flat on opposing sides of the PTC elements. The strip conductors are normally formed by parallel strips of metal. The heat-generating elements formed in this way are deployed in a heating device for heating air in a motor vehicle, where said heating device comprises multiple layers of heat-generating elements having heat-emitting elements that lie on their opposite sides. These heat-emitting elements are positioned so that they lie against the heat-generating elements in a relatively good heat-transferring contact by means of a holding device.

2. Description of the Related Art

With the aforementioned state of the art, a holding device of the heating device is formed by a frame in which multiple layers of heat-generating and heat-emitting elements that run parallel to one another are held by means of a spring bias. In an alternative development, which likewise discloses a generic heat-generating element and a generic heating device and that is described, for example, in EP 1 467 599, the heat-generating element is formed by multiple PTC elements arranged one behind the other, in a row in one level, said PTC elements also being called ceramic elements or positive temperature coefficient thermistors, and being energized on opposing side surfaces by strip conductors that lie on these side surfaces. One of the strip conductors is formed by a circumferentially closed profile, and the other strip conductor by a strip of metal that is supported at the circumferentially closed metal profile with an electrically insulating layer in between. The heat-emitting elements are formed by segments arranged in multiple parallel layers, said segments extending at right-angles to the circumferentially closed metal profile. In the generic heating device known from EP 1 467 599, multiple circumferentially closed metal profiles formed in the manner described in the preceding are provided, said metal profiles being arranged parallel to one another. To some extent, the segments extend between the circumferentially closed profiles and project beyond them to some extent.

In the case of the aforementioned heat-generating elements, there is a requirement that the electric strip conductors must be in good electrical contact with the PTC elements. Otherwise, the problem that arises is an increased transition resistance, which, particularly in the case of the use of heat-generating elements in auxiliary heaters for motor vehicles, can lead to local overheating due to the high currents. As a result of this thermal event, the heat-generating element can be damaged. Furthermore, the PTC elements are self-regulating resistance heaters that emit a lower heat output at an increased temperature, so that local overheating can lead to a disturbance in the self-regulating characteristics of the PTC elements.

In addition, at the high temperatures in the area of an auxiliary heater, vapours or gases can develop that can result in a direct hazard for persons in the passenger compartment.

Correspondingly problematic is also the use of generic heat-generating elements at high operating voltages, such as voltages up to 500 V, for example. For one thing, a problem here is that the air that flows against the heat-emitting elements carries moisture and/or dirt with it, which can penetrate into the heating device and cause an electric flashover, i.e., a short-circuit, here. On the other hand, there is fundamentally the problem of protecting persons working in the area of the heating device from the current-carrying parts of the heating device or of the heat-generating element.

In the case of heat-generating elements of the generic type, the PTC elements are usually arranged in a positioning frame that extends as a flat component essentially in the level of the PTC elements. The positioning frame serves the accurate positioning of the PTC elements during the assembly of the heat-generating element, and optionally also for holding the PTC elements during long-term operation. Because the positioning frame is made of plastic as an injection-moulded part, it consequently has certain insulating characteristics. It has been seen, however, that in generic heat-generating elements when high voltages are used, an electric flashover cannot always be avoided, due to a low resistance to leakage current.

OBJECT OF THE INVENTION

The object of the invention under consideration is to provide a heat-generating element of a heating device for heating air, as well as a corresponding heating device, offering increased safety. At the same time, the invention under consideration particularly seeks to increase the safety with regard to a possible electric flashover.

To solve this problem, the invention under consideration further develops a generic heat-generating element by supporting the at least one PTC element in the positioning frame in a highly insulating manner. In the context of the invention, a highly insulating support of the at least one PTC element is provided by means of an insulation having an electrical dielectric strength that is higher than that of the positioning frame that is formed from an electrically non-specific plastic material and that normally fits against the PTC element. The aim is to obtain high electrical dielectric strength of the material that forms the positioning frame and/or sufficient insulation of the at least one PTC element with respect to the positioning frame. The highly insulating support of the at least one PTC element in the positioning frame is accomplished in particular with the goal of high resistance to leakage current. Consequently, the PTC element should be protected against leakage current in the positioning frame by means of highly insulating support with a CTI value of at least 400, preferably 600. If the positioning frame is formed from plastic, this should be temperature-resistant. It is conceivable that the positioning frame be manufactured of polyamide. With a view to the most compact construction of the heat-generating element possible, and taking into consideration possible operating voltages of roughly 500 V, a CTI level of at least 600 should be reached.

The highly insulating support of the PTC element can be accomplished in various ways, which are explained in detail in the following. For example, the positioning frame itself can be formed from a highly insulating material, for example, an electrically non-conductive ceramic or an electrically high-grade plastic, such as, for example, polyurethane, silicone or a highly insulating elastomer. The electrical dielectric strength of the material that forms the positioning frame that fits directly against the PTC element should be at least 2 kV/mm.

Alternatively, the electrically highly effective insulating support of the PTC elements can be accomplished by means of providing an insulating gap between the PTC element and the material of the positioning frame that circumferentially surrounds the frame opening. In the proposed solution according to the invention, the insulating gap prevents the PTC element from coming into direct contact with the opposing inner surfaces of the positioning frame. The insulating gap can be an air gap that is kept free between the PTC element(s) and the material of the frame opening. In the case of this development, it must be ensured that the PTC element is circumferentially kept at a distance from the positioning frame, where the distance is sufficient to prevent an electric flashover to the positioning frame.

This positioning can particularly be accomplished by means of an insulating layer that holds the PTC element(s) in the specified position, for example, by means of connecting, particularly by gluing, the PTC element(s) directly or indirectly to the insulating layer. In addition, the insulating layer is securely held in position with respect to the positioning frame. Even although gluing the aforementioned elements is to be preferred with respect to simpler manufacture and even from the point of view of sealing the current-carrying parts from the surroundings, where this sealing can be realized by means of an adhesive layer, it is just as possible to space the PTC element(s) by means of positive locking with respect to the positioning frame, while maintaining the insulating gap. The insulating characteristics of this insulating layer are preferably selected in such a way that the insulating layer guarantees a dielectric strength of at least 2,000 V across the width of the layer composition.

Preferably one or more spacing media are provided in the insulating gap to ensure that the insulating gap necessary to prevent an electric flashover is securely maintained. It shall be understood that this spacing medium has a better electric insulating effect than the positioning frame does. It is certainly true that this can already be formed from an electrically high-grade material, such as silicone or polyurethane, for example, and the spacing medium can be made of an even better electrically insulating material, such as ceramic, for example. But with a view to the most economical manufacture of the heat-generating element possible, however, it is preferable to manufacture the positioning frame as such from an electrically non-specific, economical plastic that has no special electrically insulating characteristics, and to form the spacing medium from an electrically high-grade material on the interior side of the frame opening either completely or selectively. Preferably this spacing medium is formed by an insulating strip that lines the edge that circumferentially surrounds the frame opening. The insulating strip is preferably positively locking, particularly in the form of a casing that encompasses the face side and the opposing upper and lower sides that are adjacent to it. This casing forms a retaining groove in which the inner edge area of the positioning frame is held in the area of the frame opening in the manner of a tongue.

The spacing medium can be slid on to this inner edge area in the manner of a tongue-and-groove joint. Preferably the spacing medium is sprayed on to the edge area as a second component during the manufacture of the positioning frame using injection moulding of plastic, together with the spacing medium.

The PTC elements are ceramic elements that are produced as sintered parts and accordingly are necessarily subject to certain fluctuations with regard to their dimensions. Accordingly, normally the strip conductors that lie against opposing side surfaces of the PTC elements, which are routinely formed in the form of contact plates are provided with a width larger than that of the PTC elements. In a cross-sectional view of a longish heat-generating element, the electric strip conductors sometimes project beyond the PTC elements.

In this area, the electric strip conductors can extend essentially parallel to the upper and lower sides of the positioning frame, and, with a view to avoiding an electric flashover in this area, a further preferred development of the invention under consideration proposes that the insulating gap continues in that place between the electric strip conductors and the material of the positioning frame. While, according to the main aspect of the invention under consideration, the insulating gap lies in the support level of the PTC elements and extends essentially at a right angle to the expansion of the positioning frame, the continued insulating gap according to the preferred further development runs parallel to the plane spanned through the positioning frame. The insulating gap can be realized as an air gap in the preferred further development, as well. The formation already presented in the preceding, in which the spacing medium is connected to the positioning frame as a tongue-and-groove joint, is, however, with a view to the insulating characteristics of the spacing medium, preferably selected so that the insulating spacing medium extends up to beyond the outer edge of the electric strip conductors. In this case, the spacing medium can be provided as an insulating padding element. The padding can be provided for supporting the PTC element at the interior edge of the frame opening and/or for supporting the electric strip conductors or, optionally, the insulating layers that cover these on the outside and that lie against these. Arrangements are also conceivable in which the insulating spacing medium is formed from a hard ceramic material and, for local soft support of the PTC elements and/or the electric strip conductors and/or the insulating layers, insulating padding elements are provided between these mentioned components and the positioning frame. With a view to the simplest and most economical manufacture possible, however, developments are preferred in which the insulating spacing medium has padding characteristics and consequently the spacing medium and the padding element are formed from the same component.

According to a preferred further development of the invention under consideration, the PTC element and the electric strip conductors are completely surrounded by an electrically non-conductive encapsulation comprising the aforementioned insulating layer. The insulating encapsulation is formed by the insulating layer at the top and bottom. The interior sides of the insulating layer opposite one another are, for example, connected to one another in one or more parts by means of elastic high-grade insulating material, for example, silicone or polyurethane adhesive. These connecting adhesives can be introduced between the insulating layers and thereby connect the layer composition, consisting of the exterior insulating layers, electric strip conductors lying against them and PTC elements arranged in between, into one constructional unit, in which the hardened adhesive insulating mass forms the positioning frame.

According to a preferred further development, the insulating layer covers the current-carrying parts on both sides and connects to the edges of the positioning frame, forming a seal. In this way, an electrically non-conductive encapsulation is formed in the circumferential direction of the heat-generating element. In this preferred development, in a cross-sectional view of the heat-generating element, the energized parts, i.e., the electric strip conductors and the PTC elements arranged between them, are located in the middle. This layer composition is bordered by the insulating layer at the top and bottom. This layer, in turn, fits against the positioning frame, formed from plastic, with each of its outer edges forming a seal. In this preferred development, there is no possibility whatsoever that moisture or dirt carried along with the air flowing against the heat-generating element can reach the current-carrying parts. In this preferred development, only the current-carrying parts, especially the contact plates, project beyond the insulating layer on one or both face sides of the heat-generating element. In this position, the electric strip conductors are, however, routinely held in the holding device of the heating device and, by means of the structural elements of this holding device, the current-carrying parts can be sealed with respect to the flowing air.

The electrically non-conductive encapsulation is preferably created by means of having the sections of the insulating layer that project beyond the electric strip conductor sealed from the positioning frame with an intermediate layer of a sealing element. The sealing element is preferably formed from an insulating material, for example, from an elastic plastic. The sealing element here is preferably formed by a plastic adhesive that connects the positioning frame to the insulating layer, so that not only is a circumferential encapsulation of the current-carrying parts effected, but furthermore the current-carrying parts, together with the insulating layers attached to them, are connected to the positioning frame, forming one structural unit.

It is pointed out that the positioning frame can comprise an electrically high-grade insulating material, so that the use of a customary thermoplastic material can be completely eliminated. Consequently, the positioning frame can, for example, be formed by a uniform silicone component. Likewise, it is possible to form the positioning frame by injecting a highly insulating, preferably adhesive sealing mass between the layers fitting against the opposing side surfaces of the PTC elements. In such a case, the PTC elements can be positioned with respect to the remaining layers of the layer composition for assembling purposes and ultimately fixed in their position by injecting the highly insulating mass. In such a case, the positioning frame does not serve as a positioning aid during assembly, but instead only for ensuring a predetermined position of the PTC element(s) during long-lasting operation of the heat-emitting element.

If the positioning frame is formed as an injection-moulded component from a high-grade electrically insulating material and is used as a positioning aid during assembly, the layers that oppose each other and that fit against the PTC element can be glued into one structural unit, together with the PTC elements and the silicone frame, by means of inserting an adhesive between these layers. Even in such a case, it is possible to eliminate the use of a conventional injection-moulded part made of a customary thermoplastic for forming the positioning frame.

The electric strip conductor is preferably formed by a contact plate, which projects beyond the at least one PTC element. At least one electric contacting point is formed, on the side that projects beyond the at least one PTC element, by the contact plate, in the form of a plug connector, by means of which the electrical connection of the heat-generating element to a power supply can be made. Accordingly, the contact plate preferably projects beyond the PTC element at least on the face side of the heat-generating element. It is likewise possible, however, to form the contact plate in such a way that it projects beyond the PTC element across the width.

Preferably, the current-carrying contact plates are used in particular to hold the PTC elements within the frame opening formed by the positioning frame. Accordingly, a section of the holding frame extends between the opposing, projecting ends of the contact plates. In other words, the holding frame is also provided between the opposing contact plates, so that the current-carrying parts of the heat-generating element are held in the positioning frame in the height direction within certain borders. Keeping the insulating gap between the contact plates and the material of the positioning frame can, for example, be effected by an insulating spacing medium, which is provided in the insulating gap between the edge of the contact plate that projects beyond the PTC element and the material of the positioning frame. Preferably, this spacing medium extends in the transverse direction of the positioning frame, up to the outer end of the contact plate. The insulating spacing medium is preferably formed by a plastic material that has a dielectric strength that is higher than that of the material of the positioning frame (e.g., silicone, polyurethane).

Arrangements are conceivable in which the PTC element (s) are loosely held in the frame opening between the two contact plates. This arrangement is particularly to be made when, for reasons of good electric contacting between the PTC elements and the contact plate, there is no gluing of the two parts. In order then to avoid direct laying of the PTC elements against the material of the positioning frame surrounding the frame opening, and in order to ensure that the insulating gap is kept securely, it is proposed, according to a preferred further development of the invention under consideration, that the insulating spacing medium be formed so that it projects beyond this edge surrounding the circumference of this frame opening. The insulating spacing medium is accordingly located in the level that holds the PTC elements, directly adjacent to a face side of the PTC element that lies opposite to the positioning frame.

The sealing element extends at least lengthwise along the positioning frame. With a view to an arrangement and positioning of the sealing element that is as precise as possible, particularly with respect to the projecting ends of the insulating layer, this element is provided adjacent to a sealing medium bordering edge, said edge extending preferably completely along the length of the positioning frame and being formed by the positioning frame. This sealing medium bordering edge extends in the height direction of the positioning frame, i.e., in a direction that is aligned both at a right-angle to the width of the positioning frame and perpendicular to the length direction of the positioning frame. The sealing medium bordering edge should preferably extend along the entire length extension of the positioning frame, i.e., it should grip the sealing element at the opposite long side of the positioning frame.

A bordering edge that in any case reaches, in the height direction, to the level in which the insulating layer is located, preferably extends in the height direction in the same direction, with a view to positioning of the insulating layer that is as precise as possible. Accordingly, the respective insulating layers are provided between bordering edges that are opposite each other. At the same time, with a view to the greatest possible safety with respect to electric flashover, the face end of the insulating layer is also arranged at a distance to the insulating layer bordering edges. Because the insulating layer is not actually an electrically conductive component, however, it can certainly be tolerated, in view of economic manufacture for the insulating layer, if the insulating layer is in direct contact with the bordering edge on one side. The bordering edges principally serve the precise positioning of the insulating layer across the width of the positioning frame.

In addition to these assembly aids or contact edges that extend in the height direction, the positioning frame preferably likewise has bordering tabs that likewise extend in the height direction, i.e., in a direction at a right angle to the supporting plane of the PTC element i. e. the plane in which the plate shaped PTC-elements are arranged in. These bordering tabs project beyond the bordering edges and serve to position a heat-emitting element that lies against the heat-generating element. This heat-emitting element fits against the electric strip conductor, with the insulating layer placed in between.

While the bordering edges and the bordering tabs serve the positioning of the insulating layer resp. the heat-emitting elements in the transverse direction of the positioning frame, with a view to positioning of the various components of the heat-generating element that is as precise as possible, a further preferred development is proposed in that during the manufacture of the same, at least one attachment bar be provided at the positioning frame, said attachment bar extending at a right angle to the support layer of the PTC element, i.e., extending in the height direction, and said attachment bar serving to fix in place the insulating layer along the length of the positioning frame. Because of the bordering edges of the insulating layer and the attachment bar, the insulating layer is fixed in place relative to the positioning frame during assembly. The insulating layer is accordingly reliably arranged within the specified borders in the width and length directions.

For accurate positioning of the electric strip conductor, which is preferably formed by a contact plate, the positioning frame furthermore has pegs that extend in the height direction, i.e., at right angles to the supporting plane of the PTC element. Each of the pegs is precisely meshed in a cut that is left in the contact plate. By melting the peg, a thickening is formed above the contact plate, and the contact plate is secured to the positioning frame by means of this thickening. In this development, the contact plate is exactly positioned by the positive locking of the peg and cut. The thickening provides a positive locking of the contact plate to the positioning frame. The insulating layer is preferably glued to the unit formed in this way, whereby the glued connection is preferably located between the positioning frame and the insulating layer.

In this way, a pre-mounted structural unit, comprising the positioning frame, the at least one PTC element, the contact plates and the insulating layers, can be formed. When the heat-generating element is later brought together with the heat-emitting element, it is no longer necessary that care be taken during the later procedural steps to ensure that the individual layers of the heat-generating element are precisely positioned in the frame of the final assembly.

According to a preferred further development, the contact plate in any case forms a plug connection at one of its face sides, said plug connection being formed as a single-piece element using sheet metal forming and being shaped in such a way that it extends at a right angle to the plate level. In the mentioned further development, this plug connection is located in a slot that is made in the positioning frame and that opens outwards to a face side of the positioning frame. By means of this development, there is in any case an electric plug connection formed on the face side of the positioning frame, it being possible to slide said plug connection into a holding device of a heating device in order to connect the heat-generating element to the power supply.

Preferably, there are two slots located on the face side, and the opposite contact plates, with their plug connections formed by means of sheet metal forming, mesh in the respective slots recessed into the positioning frame.

In an alternative development, the plug connection is formed in any case by sheet metal forming of the contact plate at its face side. The plug connection preferably extends parallel to the remaining contact plate, but, by being bent, it is located in a level that is spaced outwards to the level that holds the contact plate. This preferred development is particularly suited for such arrangements in which the two contact plates on the same face side form electric connection elements that, with a view to the safest possible insulation and the space requirements of plug holders for the connections, should be spaced far apart.

If the positioning frame is formed from an electrically highly insulating material and this is a plastic, for example, silicone or polyurethane, one of the electric strip conductors, which are preferably developed in the form of a plate, is laid in the injection mould necessary for manufacturing the positioning frame using injection moulding, and connected to the plastic material of the positioning frame by means of molding around. The mould cavity is formed in such a way that when the positioning frame is injection moulded, one or more frame openings are left free, into which the PTC element(s) can be inserted. By means of positive locking parts (e.g., peg connections), an additional electric conducting element can then be mounted on the opposite side. This is preferably glued or welded to the part unit of the heat-generating element that is manufactured by means of molding around. After this manufacturing step, the essential elements of the heat-generating element are manufactured. With this embodiment, as well, care is taken here to ensure that the PTC elements are circumferentially encapsulated within the unit manufactured in that way. The electric strip conductors can, however, lay open on the face side of the heat-generating element. Then an insulating layer is preferably applied, in particular, glued, to this unit, for exterior insulating of the electric strip conductors. If the preassembled structural unit manufactured in this way is held in a frame with an initial tension, the incompressible elements of each layer, i.e., the insulating layers, the electric conducting plates and the PTC elements, lie flat against one another, whereas the soft plastic material that forms the positioning frame (e.g., electrically high-grade silicone) gives way, while nevertheless circumferentially sealing the current-carrying parts of the heat-generating element. With the preferred development, therefore, it is possible to manufacture the thickness of the positioning frame with a certain oversize, thereby creating sufficient room for holding the PTC elements, without hindering the good heat and current transfer among the PTC elements, the electric strip conductors and the insulating layers.

The previously described further developments preferably have a separate sealing element. In particular, when the positioning frame is formed from an electrically high-grade material, the sealing element can be formed just as well in a single piece with the positioning frame. This realization is necessitated anyway if the insulating layer is connected to the positioning frame on one side by means of molding around. Particularly in this further development, when the insulating layer is extruded to one side of the positioning frame, on the opposite side by means of injection moulding a sealing element is formed, against which the insulating layer on the other side of the positioning frame lies. Sealing elements can also be formed in a single piece with the positioning frame on opposing sides of the positioning frame by means of injection moulding and the insulating layers can be placed against these. In such a case, the sealing element routinely does not develop any adhesion with the positioning frame that is sufficient for the insulating layer. The insulating layer can consequently be glued on or connected to the positioning frame in another manner. Particularly in mind here is clipping an insulating layer on to the positioning frame, either by using clip elements that are arranged on the positioning frame or by using a means of latching for the insulating layer, preferably formed on the positioning frame in a single piece and particularly formed so that they are distributed continuously at least on the lengthwise edges of the positioning frame or across the entire length of the positioning frame in discrete sections. Such a means of latching can additionally be formed as an attaching and assembly aid on the side for the heat-emitting element that lies against the insulating layer. The means of latching can also be formed as a component that is separate from the positioning frame.

In the case of the invention under consideration, a heating device is furthermore put under protection, said heating device using the heat-generating element according to the invention and accordingly being able to be operated with high voltages. The heating device has multiple heat-emitting elements arranged in parallel layers that lie against opposing sides of a heat-generating element. The heat-generating and heat-emitting elements are held in a frame, which is essentially flat, with the width of said frame essentially corresponding to the width of the heat-emitting and/or heat-generating elements. Spring tensions are generated via the frame and/or conducted into the layer composition. To this end, a separate spring element can be integrated in the layer composition or it can be provided in the area of the frame. The spring can be integrated in a frame piece, such as can be derived from EP 0 350 528. Alternatively, the spring bias can also be applied by means of elastic connections of frame pieces that extend at right angles. Preferably, multiple heat-generating elements are provided in the layer composition, with a heat-emitting element fitted against the upper and lower side of each one.

The heating device according to the invention is further developed by the further development already discussed in the preceding with reference to the heat-generating element.

Further details and advantages of the invention under consideration result from the following description of embodiments, in conjunction with the drawing. These FIGS. show:

DETAILED DESCRIPTION OF THE PREFERRED EMBODIMENT

Figure 1:
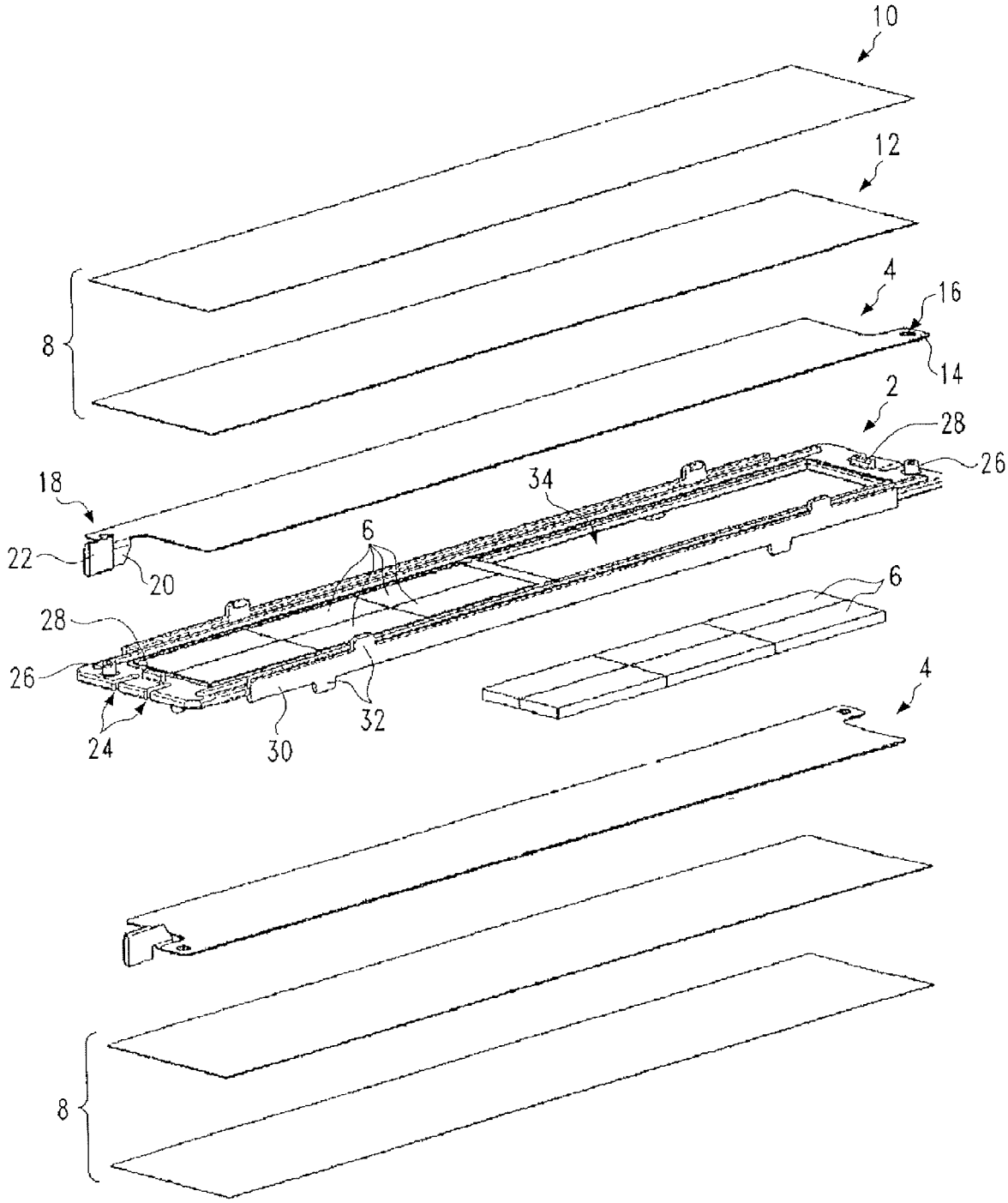
FIG. 1 a perspective side-view onto an embodiment of a heat-generating element in a blown-up representation.
Figure 2:
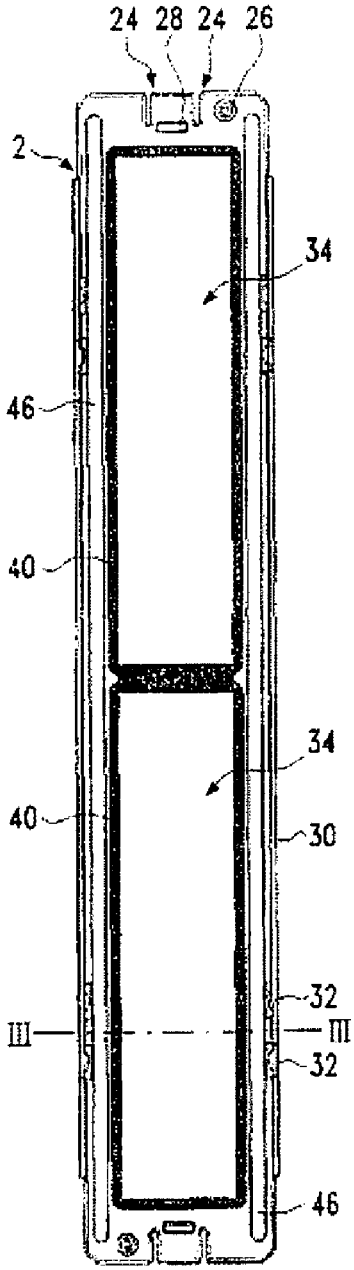
FIG. 2 a top view of the embodiment shown in FIG. 1.

FIG. 1 shows a perspective side-view of the essential parts of an embodiment of a heat-generating element in a blown-up representation. The heat-generating element has a positioning frame 2, made of injection-moulded plastic, whose middle longitudinal axis forms a bisecting plane of the heat-generating element. This element is essentially formed with one side the mirror image of the other, and initially has contact plates 4 provided on each side of the positioning frame 2, said contact plates holding between them the PTC elements 6 held in the positioning frame 2. On the exterior side of the contact plates 4 is located a two-layer insulating layer 8, comprising an exterior insulating foil 10 and an inner ceramic plate 12, that fits directly against the contact plate 4. The ceramic plate 12 is a relatively thin aluminium oxide plate that provides very good electric dielectric strength of roughly 28 kV/mm and good thermal conductivity of more than 24 W/(m K). The plastic foil 10 in this case is formed by a polyamide foil that has good thermal conductivity of roughly 0.45 W/(m K) and dielectric strength of 4 kV/mm. Located between the plastic foil 10 and the ceramic plate 12 is a wax layer, with a thickness of a few μm, whose melting point is coordinated with regard to the operating temperature of the heat-generating element, namely in such a way that the wax melts at the operating temperature and becomes distributed between the plastic foil and the ceramic plate 12, which fit closely together under compressive stress, with the distribution being of such a manner that a levelling film is created that furthers good heat transfer between the two parts 10, 12 of the insulating layer 8. The combination of plastic foil 10 and ceramic plate 12 leads to an insulating part 8 that has good electrical characteristics and thermal conductivity characteristics and, particularly with respect to voltages of up to 2,000 V, is not subject to flashover, but which simultaneously displays the necessary strength. Any stress peaks that can, in particular, be generated by pressure against heat-emitting elements that fit against the heat-generating element, are relieved and homogenized by the insulating foil positioned on the exterior. The wax that is arranged between the two parts 10, 12 of the insulating layer, as well as, optionally, an adhesive that is also provided there and that connects the two parts 10, 12 to one another, furthers this relief of stress peaks. Accordingly, there is no risk of the relatively brittle ceramic layer breaking, even at higher compressive stresses that hold a layer composition of heat-generating and heat-emitting elements under an initial tension.

The insulating layer 8 is preferably glued to the exterior side of the contact plate 4. This is located roughly centred, below the insulating layer 8, and is formed with a width less than that of the insulating layer 8. The respective contact plate 4 projects beyond the insulating layer 8, however, at the face sides. The width of the contact plate 4 is initially considerably reduced at these ends that project beyond the insulating layer 8. At the right end as seen in FIG. 1 the contact plate 4 has an attachment tab 14, which is narrowed by cutting free some of the width of the contact plate 4 and into which a cut 16 is made. At the opposite end, shown in FIG. 1 at the left, a corresponding narrowed attachment tab 18 with cut 16 is likewise provided. From the side edge of this attachment tab 18, a tab 20, bent out of the level of the contact plate 4, goes off, forming the basis of a plug connection 22 that projects beyond the positioning frame 2 on the face side.

Figure 4:
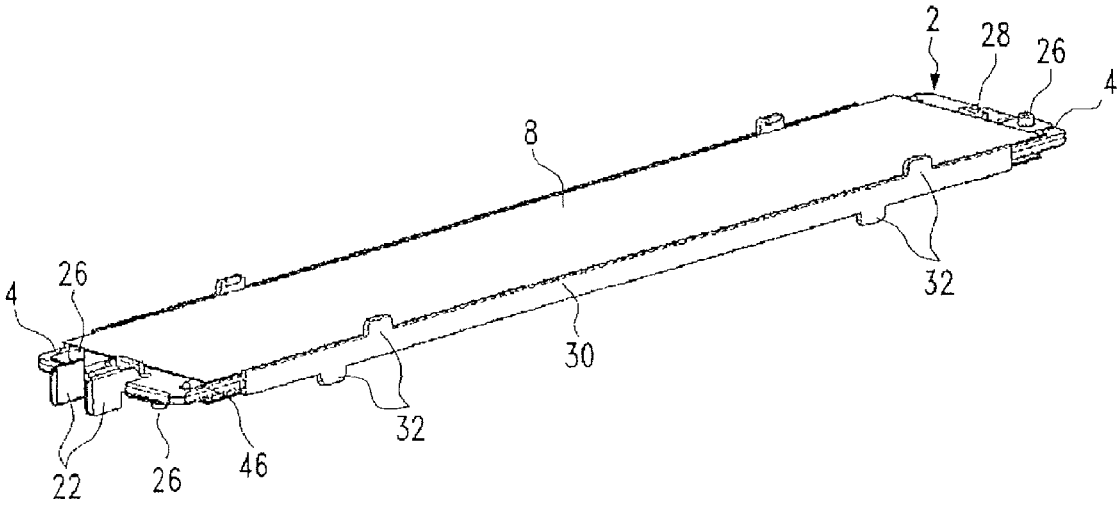
FIG. 4 a perspective side-view of the embodiment shown in FIG. 1 to 3, in the assembled state.

The tab 20 meshes with a slot 24 cut into the positioning frame 2, with said slot 24 opening towards the face side of the positioning frame 2. On its face side end regions, the positioning frame 2 furthermore has pegs 26, that extend in the height direction of the heat-generating element, i.e., that go off at a right angle from the surface of the positioning frame 2. During assembly, these pegs 26 are introduced into the cuts 16. Subsequently, the peg 26 is melted to form a thickening of melted material and the contact plate 4 is secured to the positioning frame 2 in this manner. As can be derived in particular from FIGS. 1 and 4, the positioning frame 2 has, in addition to the pegs 26, additional positioning aids for precise arrangement of the contact plate 4 on the positioning frame 2. In this way, the positioning frame 2 forms, firstly, face-sided attachment pegs 28 on the face-sided ends of the contact plate 4, said attachment pegs 28 extending slightly beyond the upper side of the contact plate 4 and being spaced at a distance to one another that roughly corresponds to the length of the contact plate 4. In this way, the contact plate 4 is positioned lengthwise. Secondly, across the width, the positioning frame 2 forms bordering edges 30 that extend along almost the entire length of the contact plate 4, said bordering edges 30 likewise extending beyond the upper side of the contact plate 4 and being spaced at a distance to one another that is slightly larger than the width of the contact plate 4. Projecting beyond this bordering edge 30 on both sides are bordering tabs 32 with locking protuberances in the interior, by means of which a heat-emitting element that is arranged on the heat-generating element can be fixed in place for assembly purposes.

Figure 3:
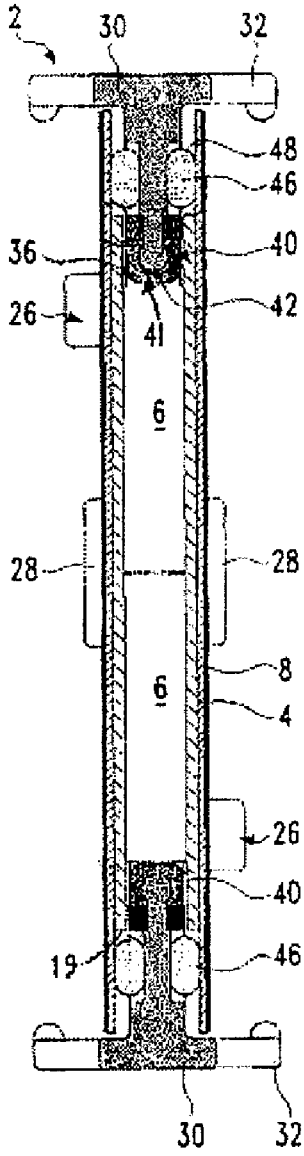
FIG. 3 a cross-sectional view along the line III-III according to the depiction in FIG. 2.

In the heat-generating element, as can be seen in FIG. 3, opposing surfaces of the PTC elements 6 fit against the interior surfaces of the contact plate 4, which are fixed in place in a frame opening 34 of the positioning frame 2. As can be seen in FIG. 1, six PTC elements 6 in each case are located within a frame opening 34. Two equally sized frame openings 34 are provided, arranged one behind the other along the length. The PTC elements are packed at a distance to the material of the positioning frame 2 by means of an insulating gap 36. This insulating gap 36 also extends in a direction parallel to the supporting plane, between the interior side of the contact plate 4 and a narrowed interior edge 38 of the positioning frame that surrounds the circumference of the frame opening 34. Accordingly, the current-carrying parts of the heat-generating element, i.e., the two contact plates 4 and the PTC elements 6, are spaced at a distance from the material of the positioning frame 2 by means of the insulating gap 38. In the embodiment shown in FIG. 1 to 4, this distance is ensured by an insulating spacing medium 40, which surrounds the front end of the interior edge 38 around the circumference. In the embodiment shown, the insulating spacing medium 40 is formed by a silicone strip that holds the front area of the interior edge 38 and surrounds it around the circumference.

It is not absolutely required that the current-carrying parts of the heat-generating element fit directly against the insulating spacing medium 40. Rather, the spacing medium is only intended to prevent the current-carrying parts from coming into direct contact with the plastic material of the positioning frame 2. The insulating characteristics of the spacing medium 40 are selected in such a way that in any case, it has a better insulating effect than does the plastic material of the positioning frame 2. The length of the spacing medium 40 across the width is selected in such a way that in any case, it extends to the end of the contact plate 4 corresponding to the width. The spacing medium 40 covers the sides of the interior edge 30 that are open to the top and to the bottom, as well as an edge 42 that is formed by the interior edge 38 and that surrounds the frame opening 34 around the circumference. In this configuration, the spacing medium 40 covers and retains the face side and the opposing upper and lower sides that are adjacent to it, in a groove like manner. In other words, respective interfacing portions of the spacing medium 40 and frame 2, e.g., near edge 42, together define a meshing tongue-and-groove joint 41 (FIG. 3). The spacing medium 40 can accordingly also be understood as the interior insulating jacket coating the edge surrounding the circumference of the frame opening 34, which prevents both direct contact between the PTC element 6 and the thermoplastic material of the positioning frame 2 and direct contact of the contact plates 4 to the positioning frame 2, and ensures a minimum distance between the named parts that is to be maintained for the electrical insulation.

In addition to electrical insulation of the current-carrying parts of the heat-generating element, the embodiment shown in FIG. 1 to 4 also offers complete encapsulation of these parts. To this end, the insulating layer has an edge section 44 that extends across (FIG. 3) the contact plate 4 on both sides. Between this edge section 44 and the interior edge 38 of the positioning frame 2 is located a sealing element 46, which is positioned in such a manner that it lies against and forms a seal with both the positioning frame 2 and the insulating layer 8. In the circumferential direction, i.e., across the width, the encapsulation accordingly has the opposing insulating layers 8 and the arrangement of two sealing elements 46, which extend essentially at right angles, with the material of the positioning frame 2 provided between them. The encapsulation is selected in such a way that no moisture or dirt can penetrate into the current-carrying parts from outside.

The sealing element 46 is formed by a plastic adhesive that fixes the insulating layer 8 in place with respect to the positioning frame 2, consequently enclosing all parts of the heat-generating element provided within the insulating layers 8. In this development, it is possible to do without fixing the PTC elements 6 in place to the contact plates 4 with respect to the insulating layer 8, with a view to positioning during operation of the heat-generating element. Nevertheless, for manufacturing reasons, such an attachment may be expedient.

Elastomers, for example, silicone or polyurethane, have proven suitable for forming the sealing element 46 in the form of an adhesive. As can particularly be derived from FIG. 2, the sealing element 46 extends along the length of the positioning frame and is provided between the outer edge of the frame opening 34 and the bordering edge 30. The sealing element fits against the interior edge 38, which has a reduced thickness. On the exterior side, directly adjacent to the sealing element 46, a sealing medium bordering edge 48 is provided that is formed by the positioning frame 2. With a view to the best possible sealing, the sealing element 46 can fit closely against this edge that extends at right angles to the accommodation level for the PTC elements.

Figure 5:
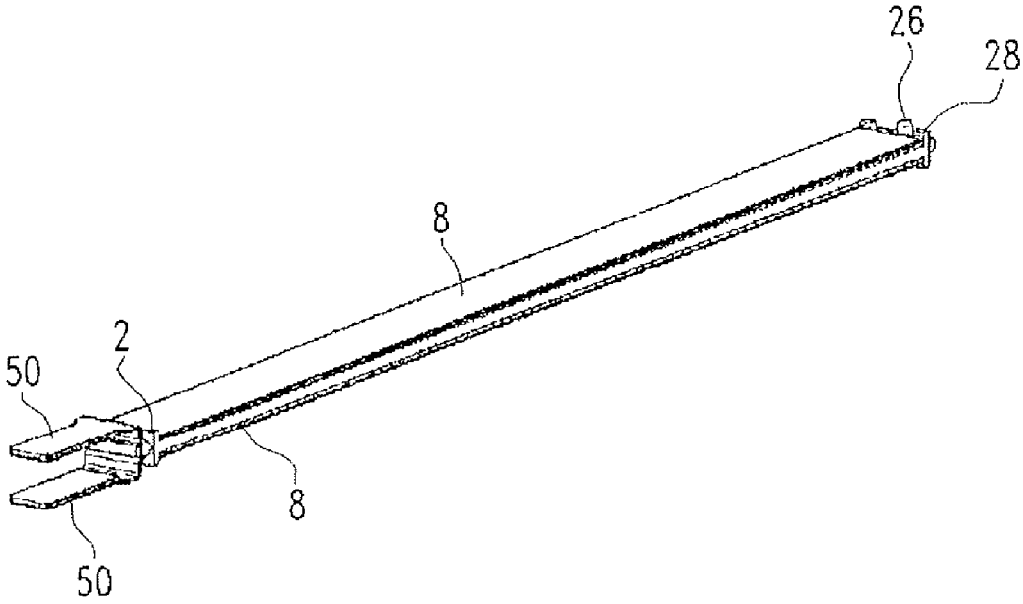
FIG. 5 a perspective side-view of a further embodiment of a heat-generating element.
Figure 6:
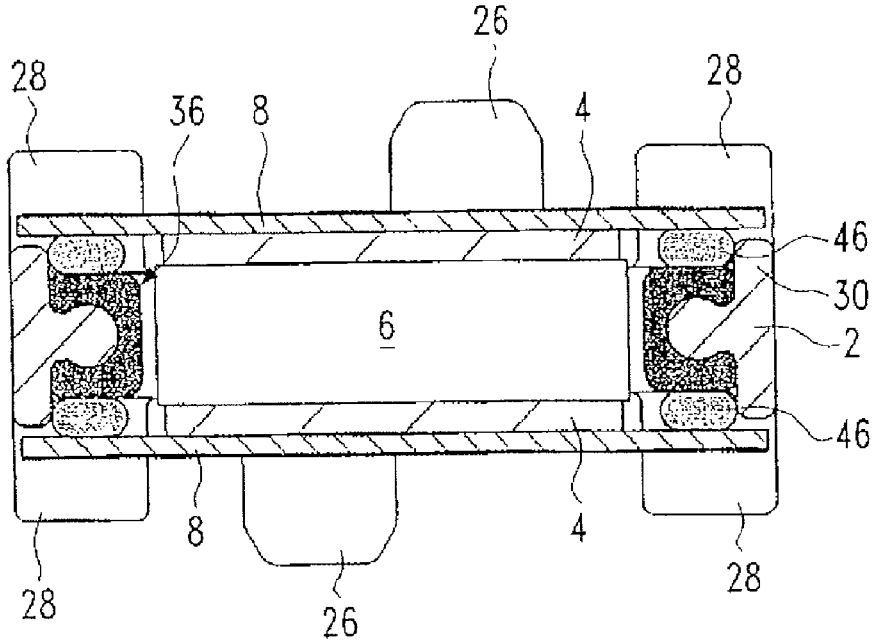
FIG. 6 a cross-sectional view along the line V-V according to the depiction in FIG. 4.

FIGS. 5 and 6 show an alternative embodiment of the heat-generating element according to the invention. Components that are the same as those in the already discussed embodiments are identified with the same reference numbers.

The embodiment shown in FIGS. 5 and 6 is narrower, i.e., it can be formed with a width that is less than that of the previously discussed embodiment. This is due to the fact that the sealing element 46 lies directly against the spacing medium 40, as can be seen in the sectional view according to FIG. 6. Each contact plate 4 has a width roughly corresponding to the width of the PTC element. Only one PTC element 6 is arranged in each of the frame openings 34. Multiple PTC elements 6 are arranged, one behind the other, along the length of the positioning frame 2. The insulating layer 8 extends across the width to the outer edge of the positioning frame 2. The bordering edge 30 serves merely for the arrangement of the sealing element 46 at the side. The sealing layer 8 likewise extends at a distance with respect to the height, to the upper edge of the bordering edge 30, so that any deviations in aligning the insulating layer 8 regarding the width with respect to the positioning frame 2 can be compensated for without interfering with the capability of the heat-generating element.

In the embodiment shown in FIGS. 5 and 6, the current-carrying parts are also encapsulated around the circumference. In a direction at a right angle to the supporting plane of the PTC elements 6, this encapsulation is formed by the two sealing elements 46 and the spacing medium 40 arranged between them.

Across the width, the exterior surface of the heat-generating element is completely level and is formed solely by the exterior surface of the insulating layer 8. Only in the area of the ends on the face sides are elements that project beyond this upper layer 8, where these elements are in the form of pegs 26 that, as already described previously with reference to the first embodiment, mesh in corresponding cuts 16 in the contact plates 4. Furthermore, attachment pegs 28 project beyond the upper side, said pegs serving in this embodiment particularly the positioning of the heat-emitting segments along the length.

To be cited as a further difference is the fact that the contact plates 4 are bent outwards at the face sides, where they form plug connections 50 that extend essentially parallel to the level of the contact plate 4. The positioning frame 2 extends along the length until beyond the area of the contact plate 4 that is bent outwards, consequently providing reliable insulation and spacing of the two current-carrying components.

It is pointed out that, in the embodiment shown in FIG. 5, it is also possible to provide only a single plug connection 50, instead of two plug connections. In this case, the energizing of the other contact plate 4 can, for example, be accomplished by means of a structural component of the holding device for holding the heat-generating elements, for example, by means of the attachment tab 14, which projects beyond the insulating layer 8 at the face side opposite the plug connection 50.

Figure 7:
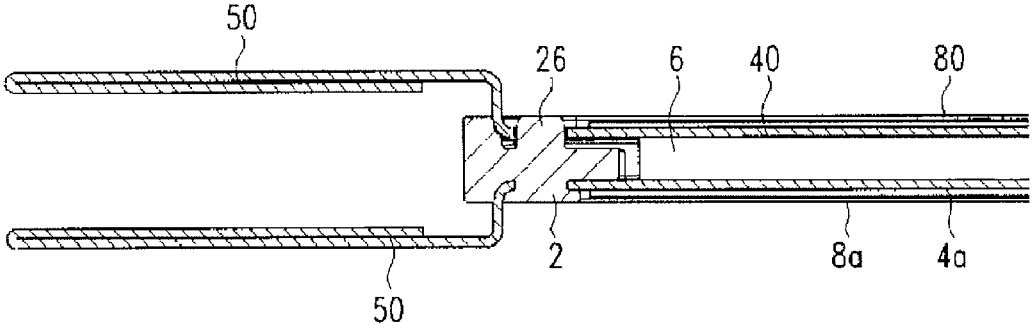
FIG. 7 a longitudinal sectional view of an alternative embodiment of a heat-generating element according to the invention.
Figure 8:
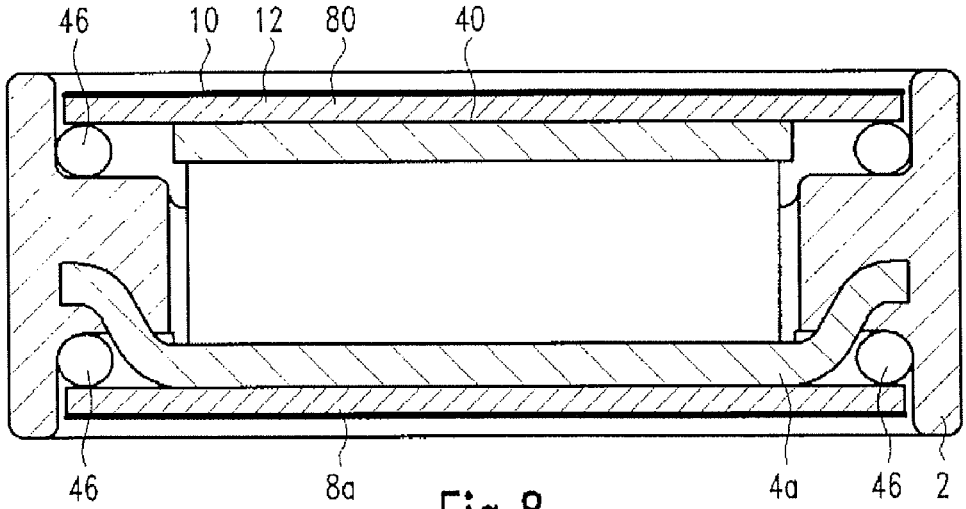
FIG. 8 a cross-sectional view of the embodiment shown in FIG. 7.

FIGS. 7 and 8 show an alternative embodiment of a heat-generating element according to the invention, said heat-generating element having a positioning frame 2 on which the existing lower contact plate 4*u* is arranged by means of molding around. After the manufacture of the positioning frame 2 by means of injection moulding, this frame forms one unit together with the lower contact plate 4*u*. To this end, the contact plate 4*u* can have cuts or through holes in its edge, through which the highly insulating plastic mass that forms the positioning frame can flow during the injection moulding, so that consequently the contact plate 4 can connect to the positioning frame 2. The lower contact plate 4*u* is bent towards the middle of the positioning frame at its ends, so that the contact plate 4*u* is securely surrounded by the material forming the positioning frame 2. In the case of the embodiment shown, the positioning frame 2 is formed from an electrically high-grade, temperature-resistant (200° C.) silicone. The embodiment accordingly has a CTI value that guarantees reliable operation at voltages of roughly 500 V.

In the case of the embodiment shown, the positioning frame is manufactured while maintaining the already described configuration, in which a sealing adhesive edge 46 is provided between the material of the positioning frame 2 and the insulating layer 8, said adhesive edge 46 being in this case formed from an elastomer adhesive. The two-sided insulating layers 8 lie against the positioning frame 2, with this adhesive strip 46 as an intermediate layer.

Figure 9:
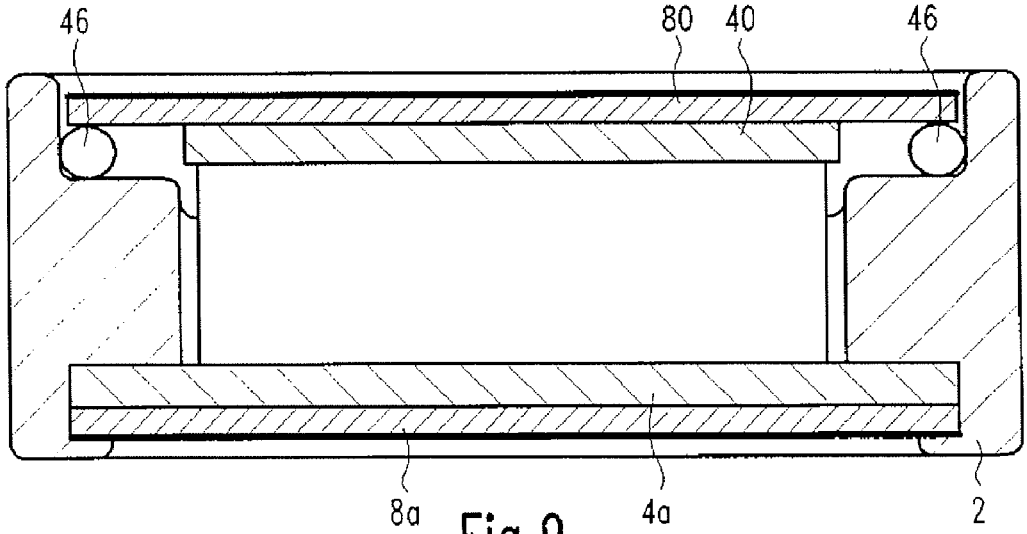
FIG. 9 a cross-sectional view of an embodiment modified with respect to the embodiment shown in FIGS. 7 and 8.

Alternative developments are also possible, however, in which both the electric strip conductor 4*u* and the insulating layer 8*u* lying against it are inserted into a mould and extruded by the highly insulating plastic mass of the positioning frame 2 (FIG. 9). After the removal of the mould, the PTC elements 6 are inserted into the frame openings 34. On the opposite side, an electric strip conductor 4 is now positioned on the PTC element(s) 6. The insulating layer 8 that is positioned directly on to this electric strip conductor 4 is connected to the positioning frame 2 with an adhesive edge with sealing function 46. Otherwise, the modification shown in FIG. 9 and described here corresponds to the previously described developments as far as the positioning of the contact plate(s) 4 and the formation of the contact elements at the face-sided end(s) of the positioning frame 2 are concerned.

Figure 10:
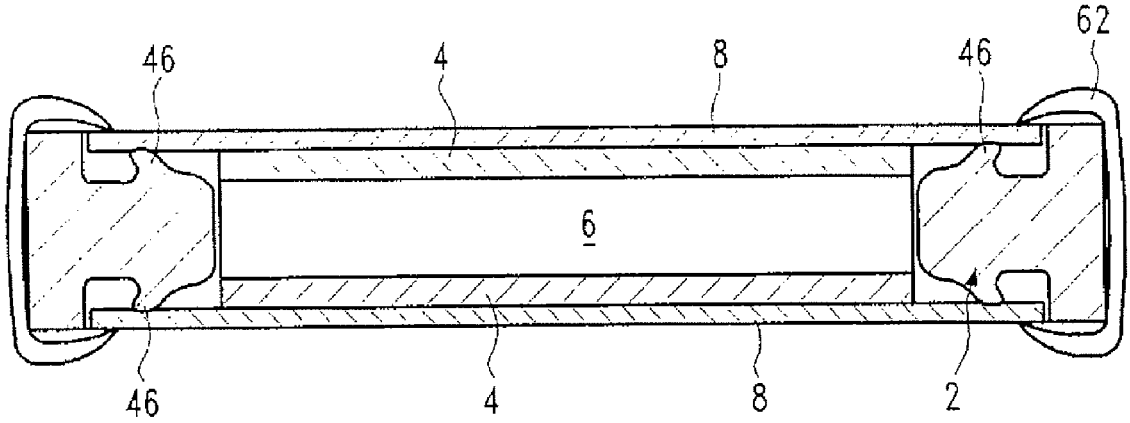
FIG. 10 a cross-sectional view of a further modified embodiment.

FIG. 10 shows a further modified embodiment. Again, components that are the same in this embodiment as in the previously discussed embodiments are given the same reference numbers.

In the embodiment shown, the sealing elements 46 are formed on opposing side surfaces of the positioning frame 2 as a single piece with the positioning frame 2 that is formed as an injection moulding component. In the embodiment shown, the positioning frame 2 is injected from silicone. The PTC elements 6 are placed into this frame 2. The insulating layers 8 are positioned on both sides on the sealing element 46. The components held within the positioning frame 2, the contact plate 4 and PTC elements 6 are clamped between the insulating layers 8. In turn, these are pretensioned with respect to one another via separate latching elements 62. The latching elements 62 can, for example, be formed by plastic clips formed in a C-shape, that both provide initial tension to the insulating layers 8 with respect to each other, with the positioning frame 2 placed in between, and also serve the relatively soft and unstable positioning frame 2 as side borders, so that the positioning frame 2 essentially cannot bulge outwards in the supporting plane of the PTC elements 6. Accordingly, the latching elements 62 are, in any case, arranged so that they are distributed at pre-determined distances along the entire length of the positioning frame 2. The snap-in protuberances of the latching elements 62 that work with the insulating layer 8 can be assigned snap-in depressions or snap-in protuberances that are mounted on sides of the insulating layer. In addition, the snap-in protuberances can be connected to the insulating layer 8 by means of gluing. Each development that, during the practical use of the heat-generating element, prevents the snap-in elements 62 from sliding away from the surface of the insulating layer 8, on the one hand, and that does not hinder the flattest possible positioning of the heat-emitting elements on the exterior side of the insulating layer 8 is conceivable.

Figure 11:
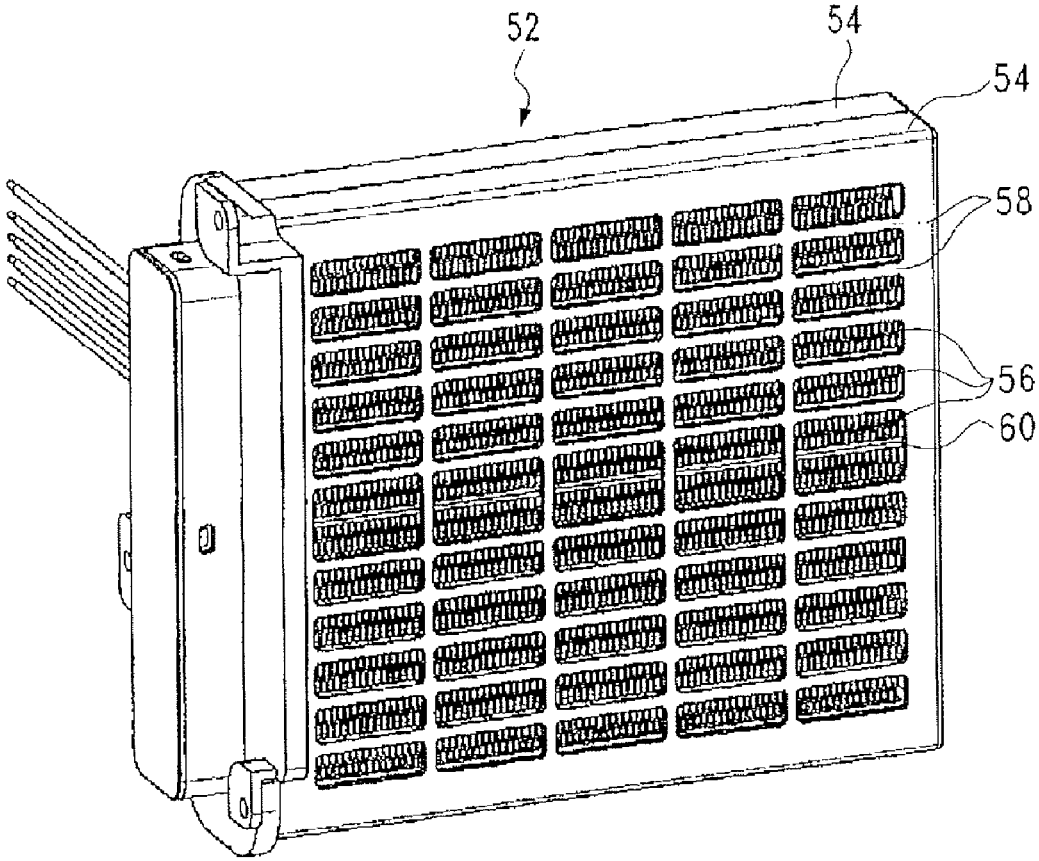
FIG. 11 a perspective side-view of an embodiment of a heating device.

FIG. 11 shows an embodiment of a heating device according to the invention. This comprises a holding device in the form of a frame 52 closed around the circumference, which is formed from two frame hulls 54. Within this frame 52, multiple layers of identically formed heat-generating elements (for example, according to FIG. 1 to 4), running parallel to one another, are held. Furthermore, the frame 52 contains a spring (not shown), by means of which the layer composition is held in the frame 52 at an initial tension. Preferably, all heat-emitting elements 56 are arranged directly adjacent to a heat-generating element. The heat-emitting elements 56 shown in FIG. 11 are formed by means of strips of aluminium plating bent in a meandering fashion. The heat-generating elements are located between these individual heat-emitting elements 56 and behind the lengthwise bars 58 of one of the air inlet or outlet openings of the grid that penetrates the frame 52. One of these lengthwise bars 58 is removed from the middle of the frame 52 for the purposes of the depiction, so that a heat-generating element 60 can be seen there.

Because the heat-emitting elements 56 fit closely against the current-carrying parts, with an insulating layer 8 placed in between, the heat-emitting elements 56, i.e., the radiator elements, are potential-free. The frame 52 is preferably formed from plastic, as a result of which the electrical insulation can be further improved. Additional protection, particularly against unauthorized contact with the current-carrying parts of the heating device, is additionally provided by the grid, which is likewise formed from plastic and developed as a single piece with the frame hulls 54.

On one face side of the frame 52, a plug connection is located in a manner known per se, with power supply lines and/or control lines going off of it, by means of which the heating device can be connected for control and power supply purposes in a vehicle. On the face side of the frame 52, a housing is indicated which can also have control or regulating elements, in addition to the plug connection.

We claim:

1. A heat-generating element of a heating device for heating air, comprising:

at least one PTC element and a positioning frame which forms at least one frame opening for holding the at least one PTC element, wherein the PTC element is supported in the positioning frame in a highly insulating manner and, wherein an insulating gap is provided between the PTC element and a portion of the positioning frame that circumferentially surrounds the frame opening, wherein an edge that circumferentially surrounds the frame opening supports an insulating strip and the insulating strip comprises a closed insulating frame that circumferentially lines the frame opening, and wherein the positioning frame forms a tongue that meshes in a retaining groove that is cut into a spacing medium that extends about the frame opening.

2. The heat-generating element according to claim 1, wherein the insulating gap prevents the PTC element from coming into direct contact with the positioning frame, and providing a dielectric strength suitable to prevent electric flashover within the heat generating element when subjected to a high voltage potential.

3. The heat-generating element according to claim 1, wherein at least one of the insulating spacing medium and the positioning frame is formed from an electrically high-grade insulating material.

4. Heat-generating element according to claim 3, wherein the high-grade insulating material is silicone.

5. The heat-generating element according to claim 1, wherein electric strip conductors lie against opposing side surfaces of the PTC element and the insulating gap continues between the electric strip conductors and the material of the positioning frame.

6. The heat-generating element according to claim 1, wherein the PTC element is connected to an electric strip conductor and, via insulating placement of the electric strip conductor with respect to the positioning frame, is arranged in such a way that an air gap is provided between the PTC element and the material of the positioning frame, said material circumferentially surrounding the frame opening.

7. The heat-generating element according to claim 6, wherein the air gap is surrounded by an insulating padding element.

8. The heat-generating element according to claim 7, wherein the electric strip conductors lies against the positioning frame either directly or via an insulating layer that is arranged on the exterior side of the electric strip conductor and that projects beyond the electric strip conductor, with a sealing element placed in between.

9. The heat-generating element according to claim 8, wherein the sealing element is formed by a plastic adhesive that connects the insulating layer to the positioning frame.

10. The heat-generating element according to claim 8, wherein the sealing element is formed as a single piece with the positioning frame as an injection-molded part.

11. The heat-generating element according to claim 10, wherein the sealing element extends at least in lengthwise direction of the positioning frame.

12. The heat-generating element according to claim 10, wherein the sealing element is arranged adjacent to a sealing medium edge that is formed by the positioning frame and that extends at least along the length of the positioning frame.

13. The heat-generating element according to claim 1, wherein the positioning frame forms bordering edges extending at a right angle to a supporting plane of the PTC element and bordering sides of an accommodation of the insulating layer.

14. The heat-generating element according to claim 5, wherein the positioning frame forms bordering edges extending at a right angle to a supporting plane of the PTC element and bordering sides of an accommodation of the electric strip conductor.

15. The heat-generating element according to claim 3, wherein the positioning frame is formed as a plastic injection-molded part from an insulating material and wherein the spacing medium is arranged on the positioning frame by molding around a highly insulating plastic component.

16. The heat-generating element according to claim 7, wherein the positioning frame is formed as a plastic injection-molded part from an insulating material and the sealing element is arranged on the positioning frame by molding around a highly insulating plastic component.

17. A heat-generating element of a heating device for heating air, comprising:

at least one PTC element and a positioning frame which forms at least one frame opening for holding the at least one PTC element, wherein the PTC element is supported in the positioning frame in a highly insulating manner and, wherein an insulating gap is provided between the PTC element and a portion of the positioning frame that circumferentially surrounds the frame opening, and wherein the positioning frame forms pegs that extend at right angles to the supporting plane of the PTC element, said pegs meshing with cuts formed in electric strip conductors and forming a thickening formed by melting, via of which the electric strip conductors are secured to the positioning frame.

18. The heat generating element according to claim 17, wherein, on one side of the positioning frame, at least one electric strip conductor is connected to the positioning frame by molding around the highly insulating material that forms the positioning frame.

19. The heat-generating element according to claim 17, wherein an insulating layer is provided adjacent to an electric strip conductor and is connected to the positioning frame by molding around it.

20. A heat-generating element of a heating device for heating air, comprising:

a positioning frame having an inner circumferential edge defining a frame opening;

a PTC element held within the frame opening of the positioning frame;

an insulating gap, defined between the PTC element and the inner circumferential edge of the positioning frame supporting the PTC element in a highly insulating manner;

first and second electric strip conductors extending parallel to each other and lying on opposing sides of the PTC element, at least one of the first and second electric strip conductors being displaced from the positioning frame; and an insulating layer covering and projecting laterally beyond an exterior side of at least one of the first and second electric strip conductors, and further comprising a sealing element provided between the positioning frame and the insulating layer, ensuring the positioning frame and the insulating layer remain insulated from each other.

* * * * *